US007904225B2

(12) United States Patent
Takeda et al.

(10) Patent No.: US 7,904,225 B2
(45) Date of Patent: Mar. 8, 2011

(54) WORKING MACHINE

(75) Inventors: Kiwa Takeda, Hirakata (JP); Masahiko Hoshiya, Hiratsuka (JP); Yoshiaki Itakura, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 657 days.

(21) Appl. No.: 11/916,132

(22) PCT Filed: Jan. 24, 2006

(86) PCT No.: PCT/JP2006/300999
§ 371 (c)(1),
(2), (4) Date: Nov. 30, 2007

(87) PCT Pub. No.: WO2006/129399
PCT Pub. Date: Dec. 7, 2006

(65) Prior Publication Data

US 2009/0132131 A1 May 21, 2009

(30) Foreign Application Priority Data

Jun. 3, 2005 (JP) ..... 2005-163681

(51) Int. Cl.
*E02F 9/24* (2006.01)
*B25D 9/00* (2006.01)

(52) U.S. Cl. ..... 701/50; 340/438

(58) Field of Classification Search ..... None
See application file for complete search history.

(56) References Cited

U.S. PATENT DOCUMENTS

| | | | | |
|---|---|---|---|---|
| 6,061,617 | A * | 5/2000 | Berger et al. | 701/50 |
| 6,119,054 | A | 9/2000 | Miki et al. | |
| 6,202,411 | B1 | 3/2001 | Yamashita | |
| 6,510,902 | B1 | 1/2003 | Prokop et al. | |
| 7,539,570 | B2 * | 5/2009 | Normann | 701/50 |

FOREIGN PATENT DOCUMENTS

| | | | |
|---|---|---|---|
| EP | 0 768 433 | A1 | 4/1997 |
| GB | 2 403 273 | A | 12/2004 |
| JP | 57-137693 | U | 8/1982 |
| JP | 07-174647 | A | 7/1995 |
| JP | 07-331707 | A | 12/1995 |
| JP | 08-68077 | A | 3/1996 |
| JP | 10-237904 | A | 9/1998 |
| JP | 11-100869 | A | 4/1999 |
| JP | 11-333757 | A | 12/1999 |
| KR | 1998-082063 | A | 11/1998 |
| KR | 100188887 | B1 | 1/1999 |
| WO | WO-03/033216 | A1 | 4/2003 |

* cited by examiner

*Primary Examiner* — Michael J. Zanelli
(74) *Attorney, Agent, or Firm* — Global IP Counselors

(57) ABSTRACT

A working machine control device is provided which can surely determine whether working equipment attached to a working machine is in an operation state. The working machine control device is configured to control a vibration generating device that is supplied with pressure oil from a hydraulic pump to generate vibration to operate working equipment attached to a working machine. The working machine control device includes a controller that is configured to obtain frequency characteristic of the pump pressure based on a pump pressure value that is detected by a pressure sensing section, and to determine whether said working equipment is in an operation state or not based on said frequency characteristic.

8 Claims, 7 Drawing Sheets

*Fig. 5*
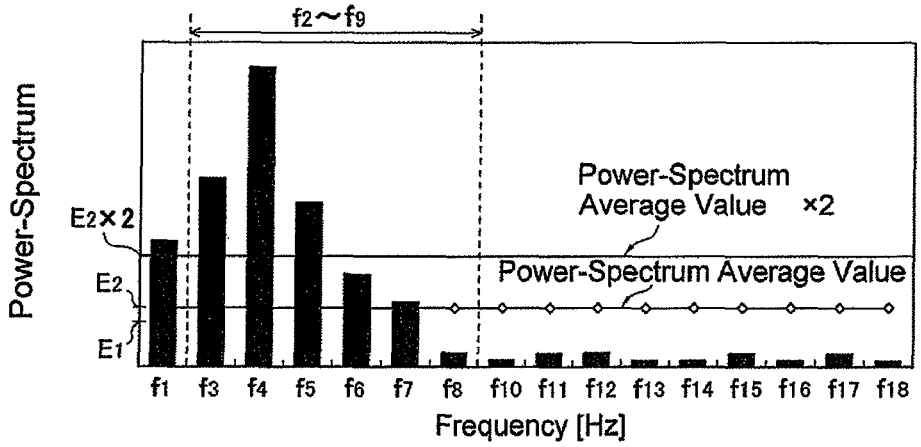
(a)
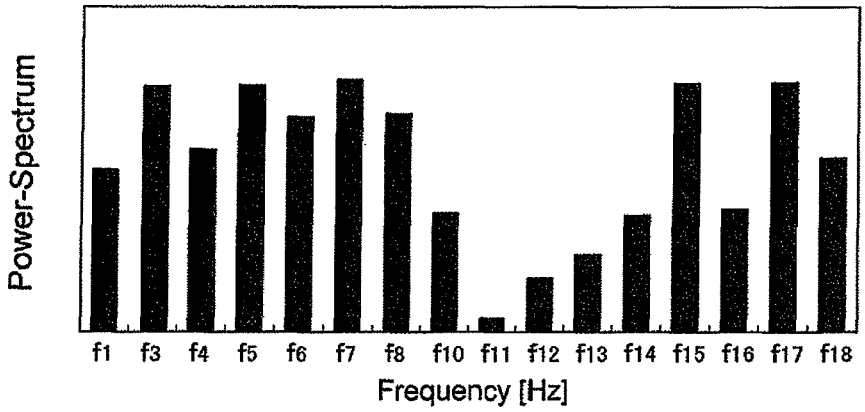
(b)
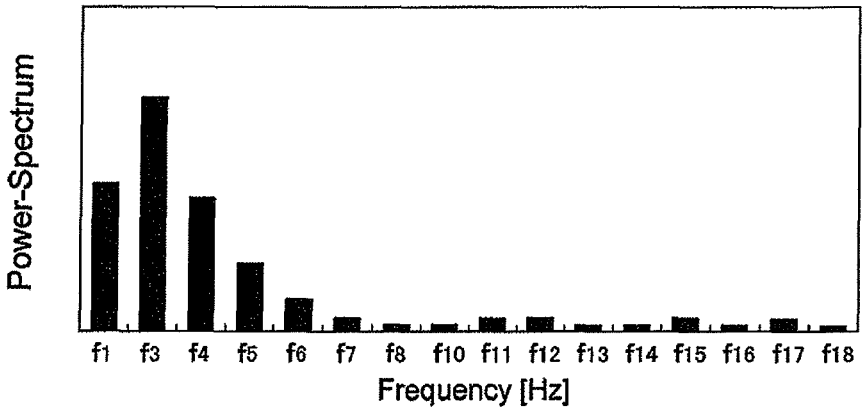
(c)

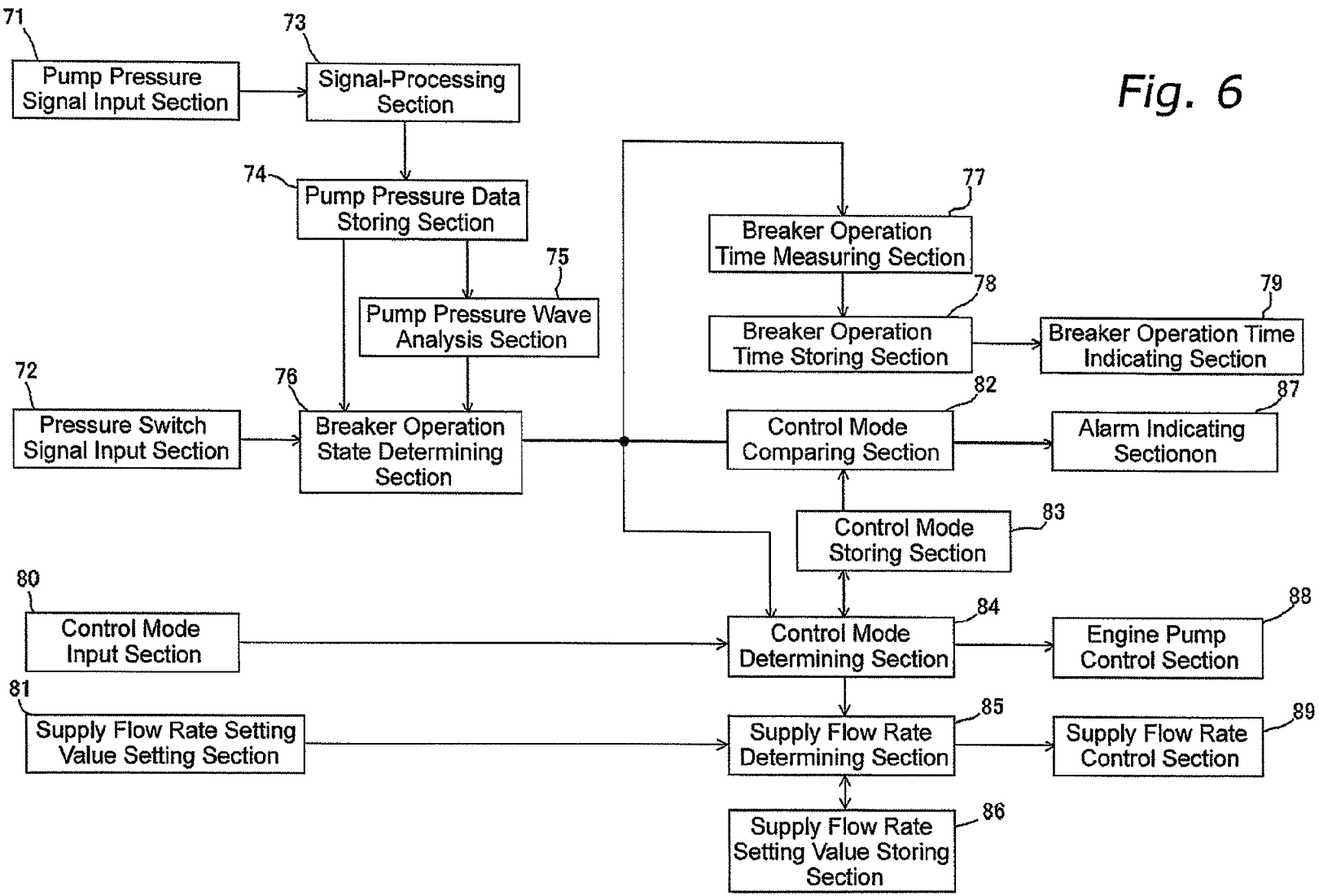
Fig. 6
71
Pump Pressure Signal Input Section
73
Signal-Processing Section
74
Pump Pressure Data Storing Section
75
Pump Pressure Wave Analysis Section
72
Pressure Switch Signal Input Section
76
Breaker Operation State Determining Section
77
Breaker Operation Time Measuring Section
78
Breaker Operation Time Storing Section
79
Breaker Operation Time Indicating Section
82
Control Mode Comparing Section
87
Alarm Indicating Sectionon
83
Control Mode Storing Section
80
Control Mode Input Section
84
Control Mode Determining Section
88
Engine Pump Control Section
81
Supply Flow Rate Setting Value Setting Section
85
Supply Flow Rate Determining Section
89
Supply Flow Rate Control Section
86
Supply Flow Rate Setting Value Storing Section

WORKING MACHINE

CROSS-REFERENCE TO RELATED APPLICATIONS

This application claims priority to Japanese Patent Application No. 2005-163681 filed on Jun. 3, 2005. The entire disclosure of Japanese Patent Application No. 2005-163681 is hereby incorporated herein by reference.

TECHNICAL FIELD

The present invention relates to a working machine that includes working equipment such as a hydraulic breaker and a hydraulic compactor that is operated by a vibration generating device that is supplied with pressure oil from a hydraulic pump and generates vibration.

BACKGROUND ART

Known examples of this type of working machine are provided by hydraulic working machines disclosed in Japanese Patent Laid-Open Publication No. 7-331707 and Japanese Patent Laid-Open Publication No. 11-100869. In the aforementioned hydraulic working machine according to Japanese Patent Laid-Open Publication No. 7-331707, if a breaker is operated in the state where a breaker mode is selected by a mode change switch, flow rate control is performed so that a hydraulic pump is brought in a constant low capacity state. Also, in the aforementioned hydraulic working machine according to Japanese Patent Laid-Open Publication No. 11-100869, if a breaker is operated by an operation pedal in the state where a breaker mode is selected by the mode change switch, the smallest discharging amount is selected from a discharging amount that is set by a maximum discharging amount setting section, a discharging amount that is subjected to positive control in accordance with the operation amount of the operation pedal, and a discharging amount that is subjected to P-Q control that limits the discharging amount so that the hydraulic pump may not be brought in an overload state. Thus, flow rate control is performed so that the discharging amount of the hydraulic pump is set to the selected discharging amount.

DISCLOSURE OF INVENTION

However, since, even in the cases of the aforementioned known working machines, the above-discussed flow rate control is not performed in the case where modes other than the breaker mode are selected by the mode change switch when the breaker is operated, the flow rate of the pressure oil that is supplied to the breaker may be excessive in some modes. This may cause damage to a machine body, hydraulic equipment, or the like.

If a working machine can be configured to surely determine whether a breaker is in an operation state, action can be taken to protect a machine body and the like. Therefore, it is possible to prevent damage to the machine body and the like. In addition to this, the degree of damage to the machine body and the like can be determined. Therefore, it is possible to optimize the timing of maintenance and the like.

The present invention is aimed at solving the these situations, and its object is to provide a working machine that can surely determine whether working equipment such as a hydraulic breaker is in an operation state.

To achieve the above object, a working machine control device according to the first aspect of the present invention is adapted to control a working machine with working equipment that is operated by a vibration generating device that is supplied with pressure oil from a hydraulic pump and generates vibration. The working machine control device includes a pressure sensing section and a controller. The pressure sensing section is configured and arranged to detect the pump pressure of said hydraulic pump. The controller is configured to obtain the frequency characteristic of the pump pressure based on a pump pressure value that is detected by the pressure sensing section, and to determine whether said working equipment is in an operation state or not based on the frequency characteristic.

The working machine control device according to the second aspect of the present invention includes an alarm issuing section that is configured and arranged to issue an alarm, and said controller is configured to selectively control the working machine in at least one of a prescribed control mode for working by using said working equipment, and a different control mode different from the prescribed control mode. In this configuration, said controller is further configured to send a control signal to said alarm issuing section to issue the alarm when the controller determines that said working equipment is in the operation state while said different control mode is executed.

The working machine control device according to the third aspect of the present invention includes a flow rate adjustment section configured and arranged to adjust the flow rate of the pressure oil that is supplied from said hydraulic pump to said working equipment, and said controller is configured to selectively control the working machine in at least one of a prescribed control mode for working by using said working equipment, and a different control mode different from the prescribed control mode. In this configuration, said controller is further configured to send a command signal to said flow rate adjustment section to limit the flow rate of the pressure oil that is supplied from said hydraulic pump to said working equipment when the controller determines that said working equipment is in the operation state while said different control mode is executed.

In the working machine control device according to the fourth aspect of the present invention, said controller is configured to selectively control the working machine in a prescribed control mode that for working by using said working equipment, and a different control mode different from the prescribed control mode. In this configuration, said controller is further configured to switch from said different control mode to the prescribed control mode as a control mode to be executed when the controller determines that said working equipment is in the operation state while said different control mode is executed.

In the working machine control device according to the fifth aspect of the present invention, when the controller determines that said working equipment is in the operation state, said controller is configured to measure the amount of operation time in which said working equipment is in the operation state and to store the accumulated amount of the operation time.

In the working machine control device according to the sixth aspect of the present invention, said controller is configured to determine whether said working equipment is in the operation state or not based on said frequency characteristic, and an amplitude center value and an amplitude value of the waveform of the pump pressure.

In the working machine control device according to the seventh aspect of the present invention, said controller is further configured to determine the type of said working equipment based on said frequency characteristic.

In the working machine control device according to the eighth aspect the present invention, said controller is further configured to determine the type of said working equipment based on said frequency characteristic, and the amplitude center value and the amplitude value of the waveform of the pump pressure.

A working machine in accordance with the present invention preferably includes the working machine control device according to any of the above aspects of the present invention.

According to the present invention, since the working machine includes the controller that obtains the frequency characteristic of the pump pressure based on the pump pressure value that is detected by the pressure sensing section and determines whether the working equipment is in an operation state or not based on the frequency characteristic, it is possible to surely determine whether the working equipment is in an operation state or not. For this reason, if the controller determines that the working equipment is in the operation state in the state where the different control mode different from the prescribed control mode that suits for working by using the working equipment such as a hydraulic breaker, the alarm issuing section issues an alarm. Therefore, it is possible to urge an operator to switch to the prescribed control mode, and thus to prevent damage to a machine body, hydraulic equipment, and the like.

Also, since, if determining that the working equipment is in the operation state in the state where the different control mode different from the prescribed control mode, the flow rate adjustment section limits the flow rate of the pressure oil that is supplied from the hydraulic pump to the working equipment, it is possible to prevent damage to a machine body, hydraulic equipment, and the like.

Also, since, if determining that the working equipment is in the operation state in the state where the different control mode different from the prescribed control mode, the controller switches from the different mode to the prescribed control mode as a control mode to be executed, it is possible to prevent damage to a machine body, hydraulic equipment, and the like.

Also, since, if determining that the working equipment is in the operation state, the controller measures the elapsed time in which the working equipment is in the operation state and stores the accumulated operation time, it is possible to determine the damaged degree of a machine body or the like based on the accumulated operation time. Therefore, it is possible to optimize the timing of maintenance and the like.

Also, since it is determined whether the working equipment is in the operation state or not based on the frequency characteristic, and the amplitude center value and the amplitude value of the waveform of the pump pressure, it is possible to more surely determine whether the working equipment is in the operation state or not.

Also, since the type of the working equipment is determined based on the frequency characteristic, it is possible to surely determine the type of the working equipment that is mounted to the working machine.

Furthermore, since the type of the working equipment is determined based on the frequency characteristic, and the amplitude center value and the amplitude value of the waveform of the pump pressure, it is possible to surely determine the type of the working equipment that is mounted to the working machine.

BRIEF DESCRIPTION OF DRAWINGS

FIG. 5 includes a plurality of diagrams (a) to (c) showing the results of frequency analysis of the pump pressure waveforms in working types.

FIG. 6 is a functional block diagram related to breaker work determination.

BEST MODE OF CARRYING OUT THE INVENTION

The following description will describe working machines equipped with working machine control devices according to exemplary embodiments of the present invention with reference to drawings. In addition, in the following embodiments, the present invention is adopted to a hydraulic shovel as a working machine.

Figure 1:
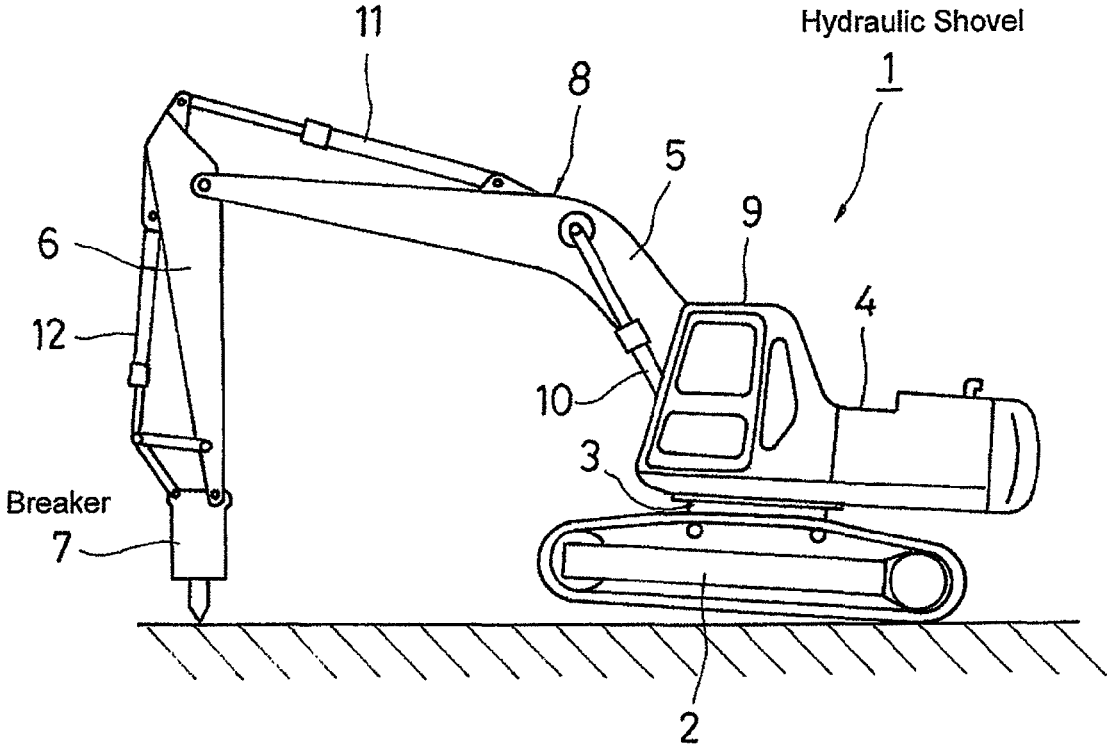
FIG. 1 is a side view of a hydraulic shovel according to a first embodiment of the present invention.

FIG. 1 is a side view of a hydraulic shovel according to a first embodiment of the present invention, and shows the state where breaker work is performed.

The hydraulic shovel 1 according to this embodiment includes a lower travel unit 2, and an upper revolving unit 4, a working portion 8, and an cab 9. The upper revolving unit 4 is mounted to the aforementioned lower travel unit 2 via a revolving apparatus 3. The working portion 8 is mounted to the front central part of the upper revolving unit 4, and includes a boom 5, an arm 6 and a breaker 7 that are pivotally coupled to each other from the upper revolving unit 4 side in this order. The cab 9 is arranged on the front left part of the upper revolving unit 4. A boom cylinder 10, an arm cylinder 11, and an attachment cylinder 12 are mounted to the aforementioned working portion 8. The boom cylinder 10 drives and pivots the boom 5. The arm cylinder 11 drives and pivots the arm 6. The attachment cylinder 12 drives and pivots the breaker 7. The working portion 8 is driven to be folded or to be raised/lowered by expanding/contracting operation of the boom cylinder 10, the arm cylinder 11, and the attachment cylinder 12. Note that, although the hydraulic breaker 7 is mounted as working equipment (working attachment) in the hydraulic shovel 1 shown in FIG. 1, the hydraulic breaker 7 can be replaced with a bucket, a hydraulic compactor, a hydraulic crusher, a hydraulic cutter or the like as an attachment for a wide variety of uses in accordance with working types.

Figure 2:
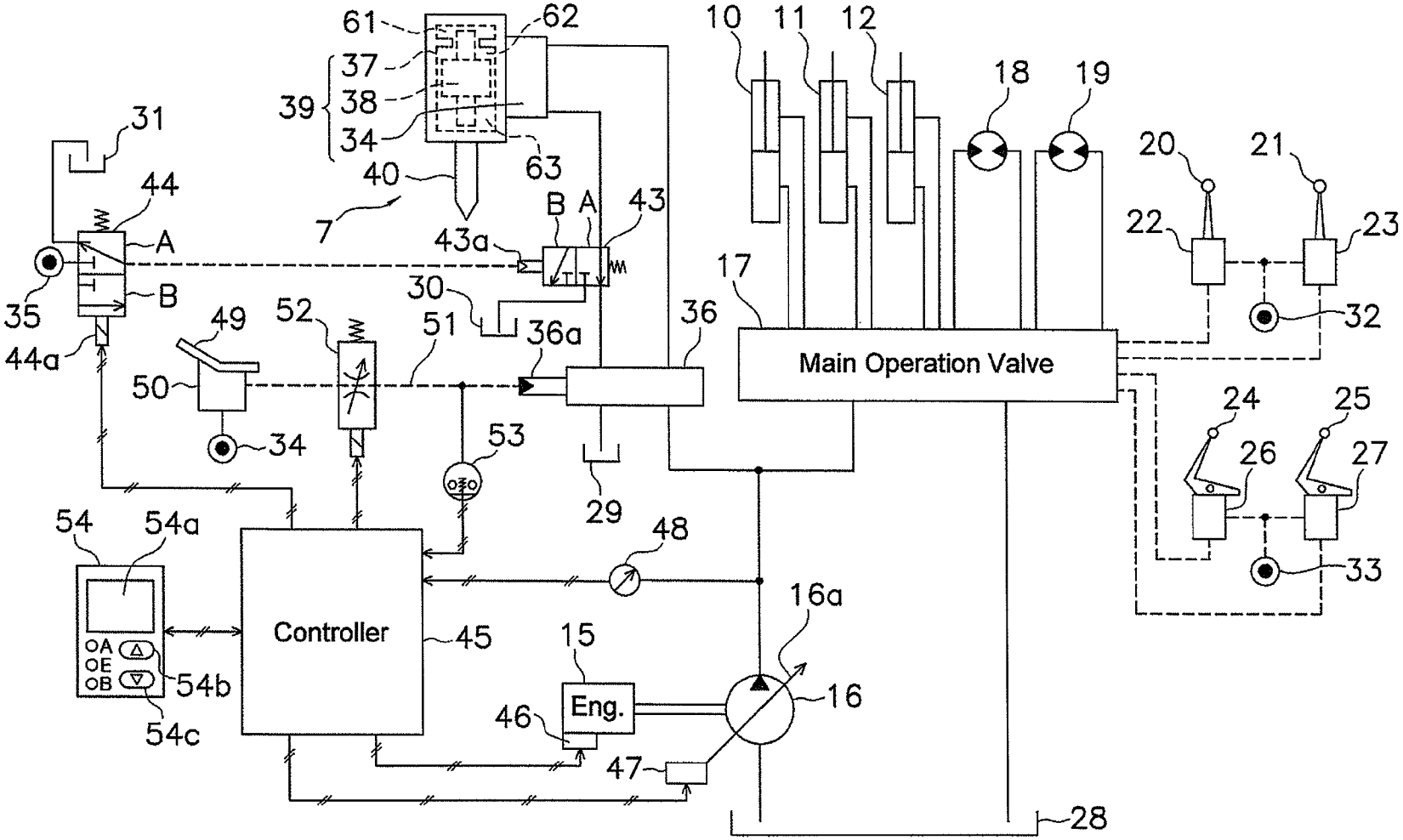
FIG. 2 is a schematic structural view of a hydraulic driving system of the hydraulic shovel according to the first embodiment of the present invention.

FIG. 2 is a schematic structural view of a hydraulic driving system of the hydraulic shovel according to this embodiment of the present invention.

In the hydraulic driving system shown in FIG. 2, pressure oil that is discharged from a hydraulic pump 16 that is driven by an engine 15 is supplied into and exhausted from the boom cylinder 10, the arm cylinder 11, the attachment cylinder 12, a travel hydraulic motor 18 that powers the lower travel unit 2, and a revolving hydraulic motor 19 that drives the revolving apparatus 3 via a main operation valve 17. The aforementioned main operation valve 17 is acted upon by pilot pressure oil from pressure reducing valves 22 and 23 that are attached to working portion control levers 20 and 21, and pilot pressure oil from pressure reducing valves 26 and 27 that are attached to travel control levers 24 and 25. The pilot pressure oil that acts upon the main operation valve 17 performs oil path switching operation of the main operation valve 17. Thus, the operation of the working portion control levers 20 and 21, and the travel control levers 24 and 25 performs folding or raising/lowering operation of the working portion 8, revolving operation of the upper revolving unit 4, and running operation of the lower travel unit 2. Note that tanks are shown by reference numerals 28, 29, 30 and 31, and pilot pressure oil sources are shown by reference numerals 32, 33, 34 and 35, in FIG. 2.

Also, the pressure oil that is discharged from the aforementioned hydraulic pump 16 is supplied to the breaker 7 via an attachment operation valve 36. This breaker 7 includes a chisel 40, and a vibration generating device 39 that vibrates the chisel 40, and is configured to suitably perform breaking work by means of the chisel 40 that is struck by a piston 38 in the vibration generating device 39. The vibration generating device 39 includes a cylinder 37, the piston 38 that is supplied with the pressure oil from the hydraulic pump 16 to vibrate within the aforementioned cylinder 37, and a flow path switching valve 34. The piston 38 is inserted in the cylinder 37. The space inside the cylinder 37 is divided into a gas chamber 61, and first and second pressure oil chambers 62 and 63. The gas chamber 61 is filled up with gas, such as nitrogen gas. The piston 38 is pressed by the pressure of the gas in the gas chamber 61 in a direction in which the piston 38 presses the chisel 40 (i.e., downward). The pressure oil that is discharged from the hydraulic pump 16 is supplied into and exhausted from the first and second pressure oil chambers 62 and 63. The first pressure oil chamber 62 is located under the gas chamber 61. If the pressure oil flows into the first pressure oil chamber 62, a force is applied to the piston 38 by the pressure of the pressure oil in the direction in which the piston 38 presses the chisel 40. The second pressure oil chamber 63 is located under the first pressure oil chamber 62. If the pressure oil flows into the second pressure oil chamber 63, a force is applied to the piston 38 by the pressure of the pressure oil in a direction in which the piston 38 departs away from the chisel 40 (i.e., upward). The flow path switching valve 34 switches between the income and the outgo of the pressure oil in the first pressure oil chamber 62, and the income and the outgo of the pressure oil in the second pressure oil chamber 63. If the flow path switching valve 34 is brought into a first state where the flow path switching valve 34 allows the pressure oil to flow out from the first pressure oil chamber 62 and to flow into the second pressure oil chamber 63, the piston 38 is raised by the pressure of the pressure oil that flows into the second pressure oil chamber 63, and departs away from the chisel 40. In this state, the gas in the gas chamber 61 is compressed by the piston 38. If the piston 38 is raised, the flow path switching valve 34 is brought in a second state where the flow path switching valve 34 allows the pressure oil to flow out from the second pressure oil chamber 63 and to flow into the first pressure oil chamber 62. Thus, the piston 38 is rapidly lowered by the pressure of the pressure oil in the first pressure oil chamber 62 and the pressure of the gas in the gas chamber 61 to strike the chisel. When the piston 38 strikes the chisel, the flow path switching valve 34 is brought into the first state again, and the aforementioned operation will be repeated.

A pilot pressure operation type switching valve 43 is interposed on a tube path 42 that connects a discharge-side port 41 of the breaker 7 and an attachment operation valve 36. The switching valve 43 is switched from a position A to a position B, when pilot pressure oil acts upon an operation portion 43*a*. When the switching valve is switched to the position B, the oil that is returned from the breaker 7 is directly drained into the tank 30. An solenoid switching valve 44 is interposed on an oil path from the operation portion 43*a* of the switching valve 43 to the pilot pressure oil source 35. The solenoid switching valve 44 is switched from the position A to the position B based on a command signal from the controller 45. When the solenoid switching valve 44 is switched to the position B, the pilot pressure oil from the pilot pressure oil source 35 acts upon the operation portion 43*a* of the switching valve 43, and thus the switching valve 43 is switched from the position A to the position B. The controller 45 preferably constitutes at least a part of the working machine control device in accordance with the illustrated embodiment.

The aforementioned engine 15 is a diesel type engine. An electronic governor 46 is attached to the engine 15. The electronic governor 46 adjusts the output of the engine 15 based on the command signal from the controller 45.

The aforementioned hydraulic pump 16 is a variable displacement type hydraulic pump that varies a discharge amount in accordance with the inclination angle of a swash plate 16*a*. The swash plate control device 47 is attached to the hydraulic pump 16 to control the inclination angle of the swash plate 16*a* based on the command signal from the controller 45. The discharge oil amount of the hydraulic pump 16 is controlled based on the command signal from the controller 45. In this embodiment, the discharge pressure (pump pressure) of the hydraulic pump 16 is detected by a pressure sensor (corresponding to a "pressure sensing section" in the present invention) 48. The detected signal is provided to the controller 45. The controller 45 performs feedback control of the hydraulic pump 16 based on the detected signal from the pressure sensor 48. Note that the pressure sensor 48 detects the pressure of the pressure oil at a position right after the pressure oil is discharged from the hydraulic pump 16 and before the pressure oil branches out the main operation valve 17 and the attachment operation valve 36.

A pressure-reducing valve 50 is attached to the attachment operation pedal 49 that operates the aforementioned breaker 7. The pilot pressure oil acts upon the operation portion 36*a* of the attachment operation valve 36 by depressing the attachment operation pedal 49. A electro-hydraulic proportional flow control valve (corresponding to a "flow rate adjustment section" in the present invention) 52 is interposed on a pilot pressure oil tube path 51 from the aforementioned pressure-reducing valve 50 to the operation portion 36*a* of the attachment operation valve 36. The valve opening degree of the electro-hydraulic proportional flow control valve 52 is adjusted based on the command signal from the controller 45. Thus, the pilot pressure oil is supplied to the operation portion 36*a* of the attachment operation valve 36 in accordance with the valve opening degree of the electro-hydraulic proportional flow control valve 52 that is adjusted based on the command signal from the controller 45. As a result, the adjustment of the valve opening degree of the attachment operation valve 36 controls the flow rate of the pressure oil that is supplied from the hydraulic pump 16 to the breaker 7. In this embodiment, the pressure switch 53 detects generation of the pilot pressure in the aforementioned pilot pressure oil tube path 51. The controller 45 is provided with an ON signal that is provided from the pressure switch 53 when the pilot pressure is generated.

A monitor panel 54 is disposed in the aforementioned cab 9 (see FIG. 1) to serve as a setting device that allows the operator to select a desired work mode from a plurality of work modes. The monitor panel 54 includes a display portion (corresponding to an "alarm issuing section" in the present invention) 54*a* that indicates the situation of a vehicle (hydraulic shovel 1), alarm information and the like, and a work mode selecting switches 54*b* and 54*c* for work mode selection. In this embodiment, the work modes that can be selected by the work mode selecting switches 54*b* and 54*c* include three modes of an active mode (mode A), an economy mode (mode E), and a breaker mode (mode B) in total. Also, when the active mode is selected by the work mode select switches 54*b* and 54*c*, an active mode setting command signal is provided from the monitor panel 54 to the controller 45. When economy mode is selected by the work mode select switches 54*b* and 54*c*, an economy mode setting command signal is provided from the monitor panel 54 to the controller 45. When the breaker mode is selected by the work mode select switches 54*b* and 54*c*, the breaker mode setting command signal is provided from the monitor panel 54 to the controller 45.

The aforementioned controller 45 mainly includes a central processing unit (CPU) that executes a predetermined program, a read-only memory (ROM) that stores the program and various types of tables, a rewritable memory (RAM) as a working memory that is required to execute the program, an input interface (an A/D converter, a digital signal generator, etc.), and an output interface (a D/A converter, etc.). The controller 45 includes a plurality of control modes. That is, the controller 45 includes the three modes of the active mode (corresponding to a "different control mode" in the present invention), the economy mode (corresponding to the "different control mode" in the present invention), and the breaker mode (corresponding to a "prescribed control mode" in the present invention) in total. If receiving the active mode setting command signal from the aforementioned monitor panel 54, the controller 45 sets the active mode as a control mode to be executed and performs later-discussed processing. Also, if receiving the economy mode setting command signal from the aforementioned monitor panel 54, the controller 45 sets the economy mode as a control mode to be executed and performs later-discussed processing. Also, if receiving the breaker mode setting command signal from the aforementioned monitor panel 54, the controller 45 sets the breaker mode as a control mode to be executed and performs later-discussed processing. Note that the aforementioned control mode may include a mode that determines control setting of the engine 15, the hydraulic pump 16 or the like irrespective of switching operation of the work mode select switches 54*b* and 54*c* as long as the mode determines control setting of the engine 15, the hydraulic pump 16 or the like in accordance with a work mode that is selected by the work mode select switches 54*b* and 54*c*.

Figure 3:
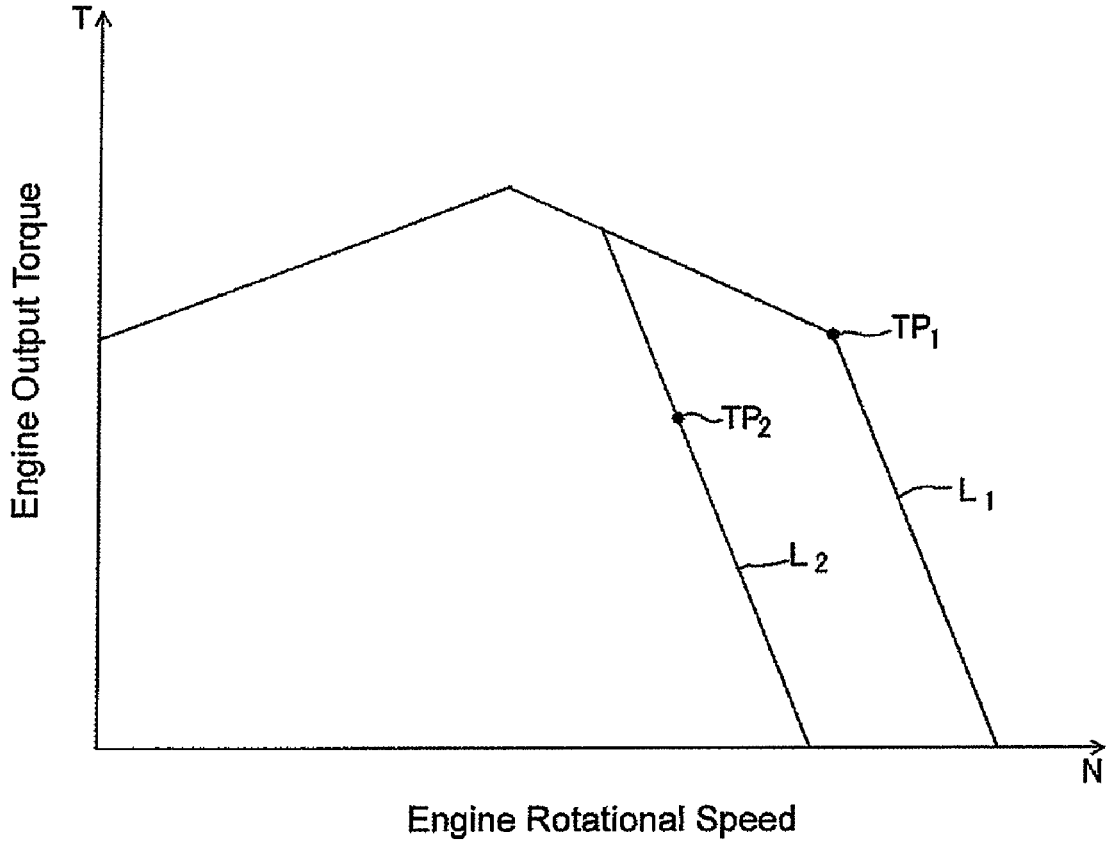
FIG. 3 is an engine power torque characteristic diagram.

In this embodiment, the aforementioned active mode is a control mode that gives a higher priority to a working amount, and executes the following processes (A) and (B). (A) The electronic governor 46 is provided with a command signal that raises the output of the engine 15 to the rated output. (B) The swash plate control device 47 is provided with a command signal that controls the discharge flow rate of the hydraulic pump 16 so that the output torque of the engine 15 and the absorption torque of the hydraulic pump 16 match to each other at the engine power torque point shown by the symbol TP1 in FIG. 3 where the output of the engine 15 becomes the rated output.

In this embodiment, the aforementioned economy mode is a control mode that gives a higher priority to fuel efficiency, and executes the following processes (C) and (D). (C) The electronic governor 46 is provided with a command signal that sets regulation shown by the symbol L2 in FIG. 3 that is shifted at a predetermined rotational speed on the lower rotational speed side from a regulation line shown by the symbol L1 in FIG. 3 that is set as full power operation of the engine 15. (D) The swash plate control device 47 is provided with a command signal that controls the discharge flow rate of the hydraulic pump 16 so that the output torque of the engine 15 and the absorption torque of the hydraulic pump 16 match to each other at the engine power torque point shown by the symbol TP2 on the aforementioned regulation line L2 in FIG. 3 where fuel consumption is relatively small and engine output is approximately 70% of the rated output. Also, the aforementioned breaker mode is a control mode that suits the work using the breaker 7, and executes the following processes (E) and (F) in addition to the aforementioned processes (C) and (D). (E) The electro-hydraulic proportional flow control valve 52 is provided to a command signal that restricts the flow rate of the pressure oil that is supplied from the hydraulic pump 16 to the breaker 7 to not more than an allowable flow rate of the breaker 7. (F) The operation portion 44*a* is provided with a command signal that switches the solenoid switching valve 44 to the position B. Note that although, in this embodiment, it is a total of three kinds, the active mode, the economy mode, and the breaker mode are included as the control modes that are set by the controller 45, a control mode other than these modes can be set in accordance with the type of work.

Figure 4:
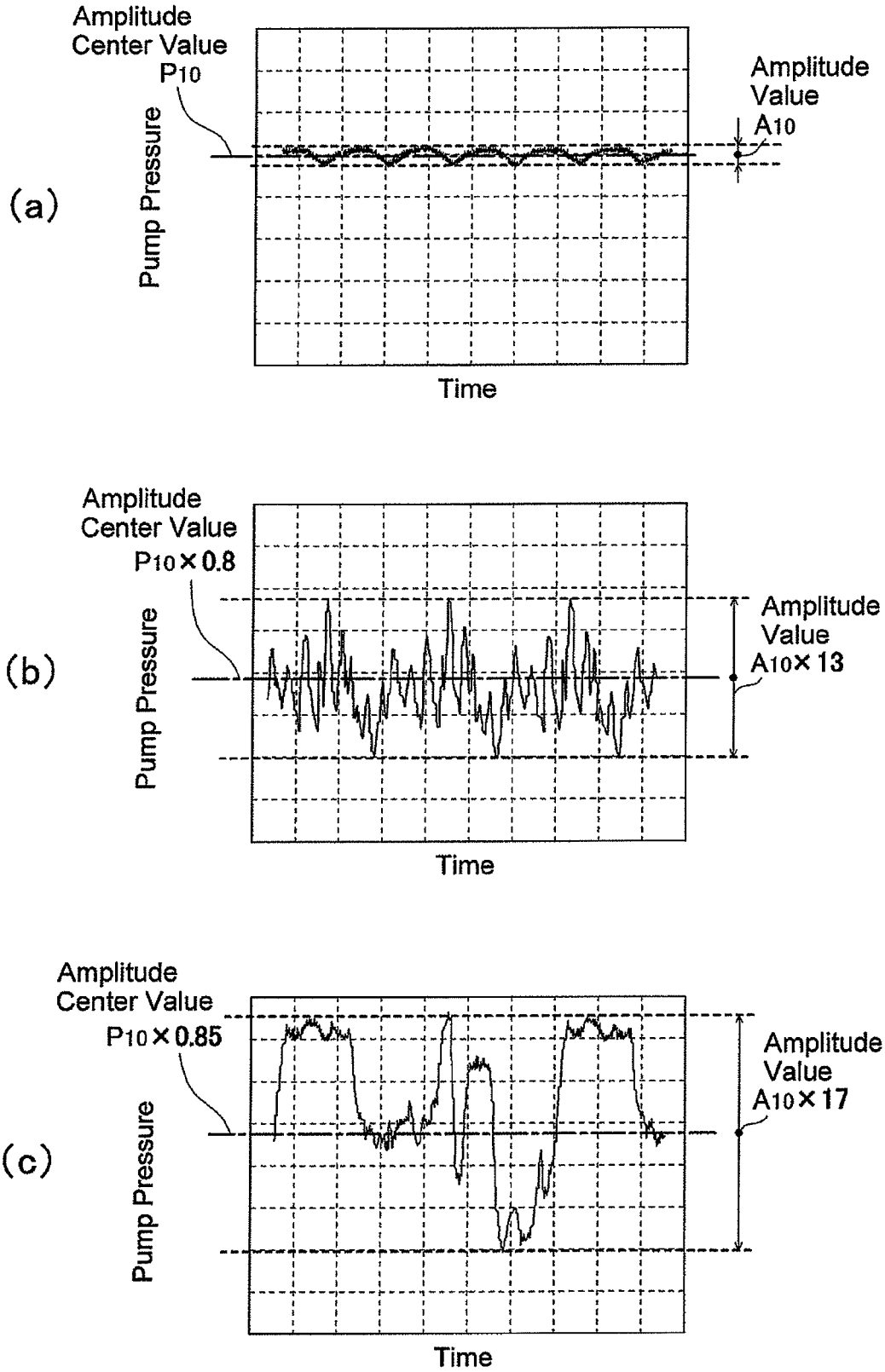
FIG. 4 includes a plurality of diagrams (a) to (c) showing exemplary pump pressure waveforms in working types.

FIG. 4 includes a plurality of diagrams (a) to (c) showing exemplary pump pressure waveforms in working types. The diagram (a) of FIG. 4 shows a pump pressure waveform in breaker work. The diagram (b) of FIG. 4 shows a pump pressure waveform in skeleton work. The diagram (c) of FIG. 4 shows a pump pressure waveform in dump truck loading work. Note that, in the diagrams (a) to (c) of FIG. 4, the vertical axes have the same scale, but the horizontal axes have different scales for the sake of clarity. Also, FIG. 5 includes a plurality of diagrams showing the frequency characteristics that are obtained by the frequency analysis of pump pressure waveforms in working types. The diagram (a) of FIG. 5 shows the frequency analysis of the pump pressure waveform in breaker work. The diagram (b) of FIG. 5 shows the frequency analysis of the pump pressure waveform in skeleton work. The diagram (c) of FIG. 5 shows the frequency analysis of the pump pressure waveform in dump truck loading work.

The amplitude center value of the pump pressure waveform in breaker work shown in the diagram (a) of FIG. 4 is P10, and its amplitude is A10. In contrast to this, the amplitude center value of the pump pressure waveform in skeleton work shown in the diagram (b) of FIG. 4 is approximately 0.8 times the value of P10, and its amplitude is approximately thirteen times the value of A10. Also, the amplitude center value of the pump pressure waveform in dump truck loading work shown in the diagram (b) of FIG. 4 is approximately 0.85 times the value of P10, and its amplitude is approximately seventeen times the value of A10. Accordingly, the aforementioned amplitude center value P10 and the amplitude A10 can be used as exemplary reference values for determination whether the breaker 7 is in the operation state or not. The controller 45 stores in advance a prescribed range of P10×0.9 to P10×1.1 that is slightly broadened from the amplitude center value P10, and a prescribed range of A10×0.9 to A10×1.1 that is slightly broadened from the amplitude A10. The prescribed ranges are used as exemplary criteria for determination whether the breaker 7 is in the operation state or not.

Also, the frequency characteristics shown in the diagrams (a) to (c) of FIG. 5 are different from each other in types of work. The frequency characteristics can be used as exemplary reference values for determination whether the breaker 7 is in the operation state or not. More specifically, a prescribed frequency characteristic for a prescribed type of work is preferably set in advance based on the frequency analysis results obtained by experimentally performing different types of work (e.g., breaker work, skeleton work, damp truck loading work, etc.) as well as by experimentally operating different working equipments of the same kind (e.g., breakers having the same specification manufactured by different manufacturers). For example, it is found in experiments that, when the breaker 7 is in the operation state, a particular frequency characteristic is obtained in which the frequency component (e.g., f3 (Hz), f4 (Hz) and f5 (Hz)), which is not less than twice the power-spectrum average value E2 and is not less than a prescribed threshold value E1 in absolute value, is included in the prescribed frequency range (e.g., the frequency range from f2 (Hz) to f9 (Hz)) as shown in the diagram (a) of FIG. 5. Accordingly, in this embodiment, if the result of the frequency analysis of the pressure variation of the pump pressure shows that a frequency component, which is not less than twice the power-spectrum average value E2 and is not less than the prescribed threshold value E1 in absolute value, is included in the prescribed frequency range (e.g., from f2 (Hz) to f9 (Hz)), it can be determined that the breaker 7 is in the operation state. Note that the controller 45 stores in advance this determination logic.

FIG. 6 is a functional block diagram related to the breaker work determination. Also, Table 1 shows exemplary processes of various types of sections and component devices in the block diagram of FIG. 6.

TABLE 1

| Num. | Section | Processing | Component Device |
|---|---|---|---|
| 71 | Pump pressure signal input section | Obtainment of pressure waveform signal of pump | Pressure sensor 48, a/d converter |
| 72 | Pressure switch signal input section | Obtainment of state of pressure switch | Pressure switch 53, digital signal generator |
| 73 | Signal-processing section | Primary processing (primary delay filtering) on pump pressure waveform | CPU |
| 74 | Pump pressure data storing section | Creation of FFT (fast Fourier transform) analysis data | Memory |
| 75 | Pump pressure wave analysis section | Execution of FFT analysis | CPU |
| 76 | Breaker operation state determining section | Determination whether breaker is in operation state based on FFT analysis result, etc. | CPU |
| 77 | Breaker operation time measuring section | Measurement of breaker operation time | CPU |
| 78 | Breaker operation time storing section | Storage of breaker operation time | Memory |
| 79 | Breaker operation time indicating section | Indication of breaker operation time | External display (display portion 54a, PC monitor, etc.) |
| 80 | Control mode input section | Input of control mode (mode A, B, C, etc.) | Switch (monitor panel 54) |
| 81 | Supply flow rate setting value input section | Input flow rate setting value of pressure oil to be supplied to breaker | Switch (monitor panel 54) |
| 82 | Control mode comparing section | Comparison of control mode, and determination whether alarm command signal is provided | CPU |
| 83 | Control mode storing section | Storage of current control mode | Memory |
| 84 | Control mode determining section | Determination of control mode | CPU |
| 85 | Supply flow rate determining section | Determination of flow rate of pressure oil to be supplied to breaker | CPU |
| 86 | Supply flow rate setting value storing section | Storage of current flow rate setting value of pressure oil to be supplied to breaker | Memory |
| 87 | Alarm indicating section | Indication of alarm | Display Portion 54a |
| 88 | Engine pump control section | Control of engine and oil pressure pump in accordance with control mode | CPU, D/A converter, electronic governor 46, swash plate control device 47 |
| 89 | Supply flow rate control section | Control of flow rate of pressure oil to be supplied to breaker | CPU, D/A converter, electro-hydraulic proportional flow control valve 52 |

In the block diagram shown in FIG. 6, the pressure waveform signal of the hydraulic pump 16 that is obtained by a pump pressure signal input section 71 is subjected to primary delay filtering in a signal-processing section 73, and is then sent to a pump pressure data storing section 74. The pump pressure data storing section 74 creates and stores pump pressure data based on the necessary sampling data that is obtained at a predetermined sampling period from the aforementioned pressure waveform signal that is subjected to the signal processing. The pump pressure data is provided to a pump pressure wave analysis section 75 and a breaker operation state determining section 76.

The aforementioned pump pressure power wave analysis section 75 performs Fourier transform (Fast Fourier Transform) on the pump pressure data from the pump pressure data storing section 74, and performs the frequency analysis of the pump pressure waveform. Also, the breaker operation state determining section 76 determines whether the breaker 7 is in the operation state or not based on the pump pressure data from the pump pressure data storing section 74, the result of the frequency analysis by the pump pressure wave-analysis section 75, and the state of the pressure switch 53 that is obtained by a pressure switch signal input section 72. The result of determination is provided to a control mode comparing section 82, a control mode determining section 84, and a breaker operation time measuring section 77.

The aforementioned control mode comparing section 82 compares the result of determination by the breaker operation state determining section 76 with the current control mode that is stored by a control mode storing section 83, and determines whether to provide an alarm command signal. If the control mode comparing section 82 provides the alarm command signal, an alarm is indicated by an alarm indicating section 87.

Also, the aforementioned control mode determining section 84 determines a control mode to be executed based on the result of determination by the breaker operation state determining section 76, the control mode that is selected by a control mode input section 80, and the current control mode that is stored by the control mode storing section 83. An engine pump control section 88 then controls the output of the engine 15, and the discharge flow rate of the hydraulic pump 16 in accordance with the control mode that is determined by the control mode determining section 84.

Also, if receiving the result of determination that the breaker 7 is in the operation state from the breaker operation state determining section 76, the breaker operation time measuring section 77 measures the operation time of the breaker 7. The result of the measurement is stored by a breaker operation time storing section 78, and is indicated by a breaker operation time indicating section 79.

Also, in the block diagram shown in FIG. 6, a supply flow rate determining section 85 is provided with a signal from a supply flow rate setting value input section 81 that sets the flow rate setting value of the pressure oil to be supplied to the breaker 7. The supply flow rate determining section 85 determines the flow rate of the pressure oil to be supplied to the breaker 7 based on the flow rate setting value by the supply flow rate setting value input section 81, the current flow rate setting value that is stored by a supply flow rate setting value storing section 86, and the control mode that is determined by the aforementioned control mode determining section 84. A supply flow rate control section 89 then controls the flow rate of the pressure oil that is supplied to the breaker 7 based on the flow rate that is determined by the supply flow rate determining section 85.

Figure 7:
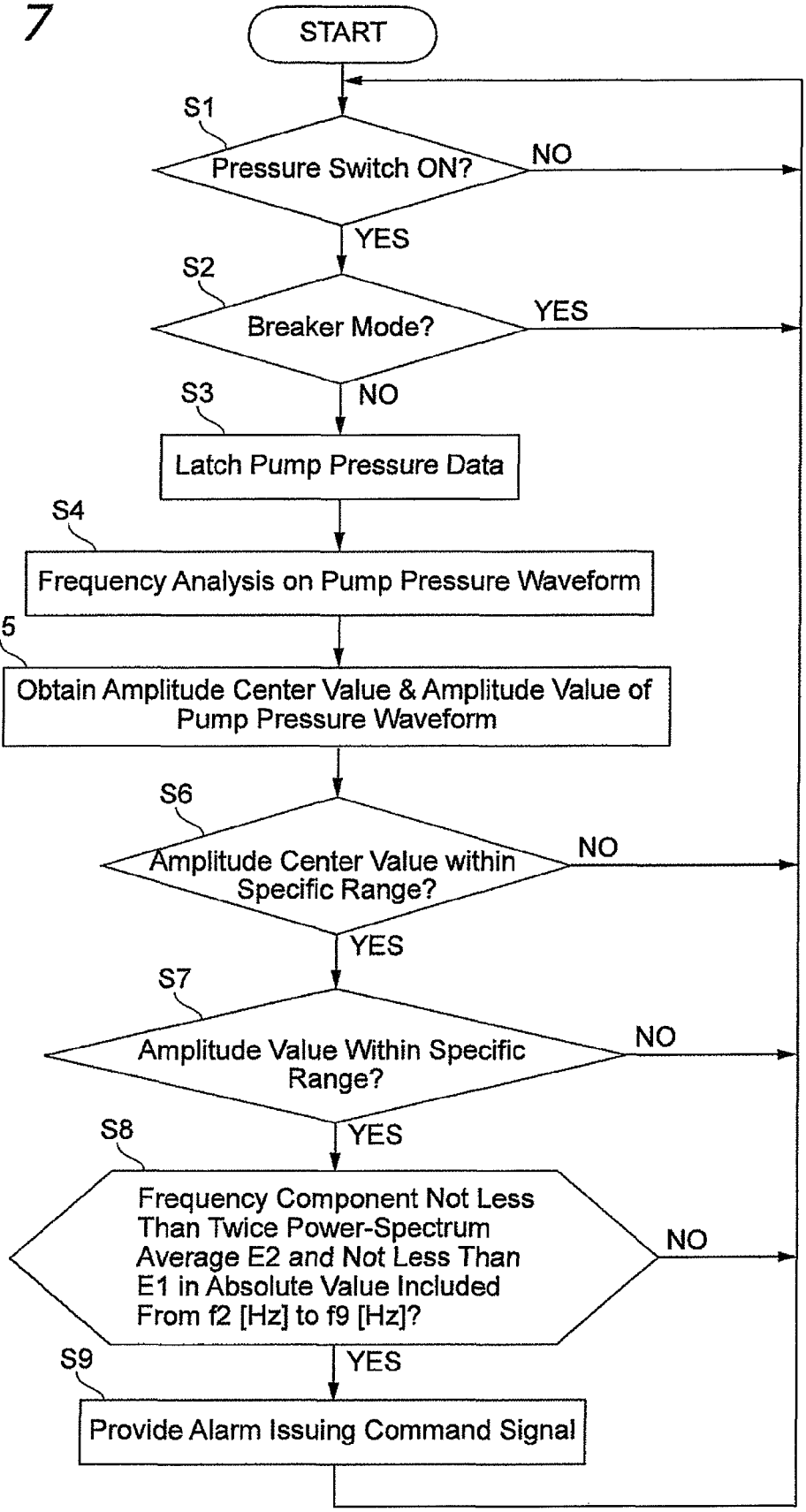
FIG. 7 is a flow chart showing the processing of a controller according to the first embodiment.

FIG. 7 is a flow chart showing the processing of the controller according to this embodiment. Note that symbols "S" in FIG. 7 show steps.

In the flow chart shown in FIG. 7, if it determined based on an ON signal from the pressure switch 53 that the attachment operation pedal 49 is depressed, it is then determined whether the currently-executed control mode is the breaker mode or not (S1 and S2). If the currently-executed control mode is not the breaker mode, in other words, is a mode other than the breaker mode (e.g., the active mode), the pump pressure value that is detected by the pressure sensor 48 is monitored at a predetermined period, and the data of the pump pressure value is maintained (S3). The pump pressure data that is latched in Step S3 is subjected to Fourier transform (fast Fourier transform), and the frequency analysis on the pump pressure waveform is executed (S4). Subsequently, the amplitude center value and the amplitude value of the pump pressure waveform are calculated based on the pump pressure data (S5). After that, if the amplitude center value falls within the range P10×0.9 to P10×1.1, and the amplitude value falls within the range A10×0.9 to A10×1.1, and additionally if a frequency component is included which is not less than twice the power-spectrum average value E2, and is not less than E1 in absolute value, in the frequency range from f2 (Hz) to f9 (Hz), it is determined that the breaker 7 is in the operation state, and thus the command signal for indication of an alarm is provided to the monitor panel 54 (S6 to S9). As a result, an alarm is indicated on the display portion 54*a* of the monitor panel 54.

According to this embodiment, since, if the controller 45 determines that the breaker 7 is in the operation state in the state where the active mode is executed, an alarm is indicated on the display portion 54*a* of the monitor panel 54, it is possible to urge an operator or the like to switch to the breaker mode. Therefore, it is possible to prevent damage to a machine body, hydraulic equipment, and the like.

Note that, although, in this embodiment, an example of the alarm issuing section is provided by the display portion 54*a* that indicates an alarm in response to the command signal from the controller 45, the present invention is not limited to this. The alarm issuing section may be a buzzer that emits an audible alarm in response to the command signal from the controller 45, a voice alarm that generates a voice alarm message in response to the command signal from the controller 45, or the like. In addition to this, the aforementioned display portion 54*a*, and the aforementioned buzzer and voice alarm may be suitably combined. In this case, it is possible to further attract the attention of the operator. Furthermore, needless to say, the aforementioned buzzer and voice alarm can be installed inside the monitor panel 54, or can be disposed separately from the monitor panel 54.

Second Embodiment

Basically, hardware configuration according to this embodiment is similar to the hardware configuration shown in FIG. 2 according to the foregoing first embodiment except that processing of the controller 45 is partially different from the first foregoing embodiment. More specifically, only the processing of Step S9 in the flow chart shown in FIG. 7 is different from the first foregoing embodiment. The following description will mainly describe this difference.

If it is determined that the breaker 7 is in the operation state in Step S8, the electro-hydraulic proportional flow control valve 52 is provided with a command signal that restricts the flow rate of the pressure oil to be supplied from the hydraulic pump 16 to the breaker 7 to not more than the allowable flow rate of the breaker 7 (or zero). Thus, the pilot pressure oil is supplied to the operation portion 36*a* of the attachment operation valve 36 in accordance with the valve opening degree of the electro-hydraulic proportional flow control valve 52 that is adjusted based on the command signal from the controller 45. As a result, the adjustment of the valve opening degree of the attachment operation valve 36 restricts the flow rate of the pressure oil that is supplied from the hydraulic pump 16 to the breaker 7 to not more than the allowable flow rate of the breaker 7 (or zero).

According to this embodiment, since, if the controller 45 determines that the breaker 7 is in the operation state in the state where the active mode is executed, the electro-hydraulic proportional flow control valve 52 restricts the flow rate of the pressure oil to be supplied from the hydraulic pump 16 to the breaker 7 to not more than the allowable flow rate of the breaker 7 (or zero), it is possible to prevent damage to a machine body, hydraulic equipment, and the like.

Third Embodiment

Basically, hardware configuration according to this embodiment is similar to the hardware configuration shown in FIG. 2 according to the foregoing first embodiment except that processing of the controller 45 is partially different from the first foregoing embodiment. More specifically, only the processing of Step S9 in the flow chart shown in FIG. 7 is different from the first foregoing embodiment. The following description will mainly describe this difference.

If it is determined that the breaker 7 is in the operation state in Step S8, the active mode is switched to the breaker mode as a control mode to be executed. Accordingly, the following processes (C), (D), (E) and (F) is executed. (C) A command signal that sets regulation shown by the symbol L2 in FIG. 3 that is shifted at a predetermined rotational speed on the lower rotational speed side from a regulation line shown by the symbol L1 in FIG. 3 that is set as full power operation of the engine 15. (D) The swash plate control device 47 is provided with the command signal that controls the discharge flow rate of the hydraulic pump 16 so that the output torque of the engine 15 and the absorption torque of the hydraulic pump 16 match to each other at the engine power torque point shown by the symbol TP2 on the aforementioned regulation line L2 in FIG. 3 where fuel consumption is relatively small and engine output is approximately 70% of the rated output. (E) The electro-hydraulic proportional flow control valve 52 is provided with the command signal that restricts the flow rate of the pressure oil to be supplied from the hydraulic pump 16 to the breaker 7 to not more than the allowable flow rate of the breaker 7. (F) The operation portion 44*a* is provided with a command signal that switches the solenoid switching valve 44 to the position B.

Execution of the aforementioned processes (C) and (D) sets the output of the hydraulic pump 16 to a suitable pump output for breaker work. Also, execution of the aforementioned process (E) supplies the pilot pressure oil to the operation portion 36*a* of the attachment operation valve 36 in accordance with the valve opening degree of the electro-hydraulic proportional flow control valve 52 that is adjusted based on the command signal from the controller 45. As a result, the adjustment of the valve opening degree of the attachment operation valve 36 restricts the flow rate of the pressure oil that is supplied from the hydraulic pump 16 to the breaker 7 to not more than the allowable flow rate of the breaker 7. Also, execution of the aforementioned process (F) allows the pilot pressure oil from the pilot pressure oil source 35 to act upon the operation portion 43*a* of the switching valve 43 so that the switching valve 43 is switched to from the position A to the position B. As a result, the oil that is returned from the breaker 7 is directly drained into the tank 30. Note that, since, when the oil that is returned from the breaker 7 is directly drained into the tank 30, the back pressure of the breaker 7 becomes almost zero, the striking operation by the breaker 7 is more effectively conducted.

According to this embodiment, since, if the controller 45 determines that the breaker 7 is in the operation state in the state where the active mode is executed, the active mode is switched to the breaker mode as a control mode to be executed, it is possible to prevent damage to a machine body, hydraulic equipment, and the like.

Fourth Embodiment

Basically, hardware configuration according to this embodiment is similar to the hardware configuration shown in FIG. 2 according to the foregoing first embodiment except that processing of the controller 45 is partially different from the first foregoing embodiment. More specifically, only the processing of Step S9 in the flow chart shown in FIG. 7 is different from the first foregoing embodiment. The following description will mainly describe this difference.

If it is determined that the breaker 7 is in the operation state in Step S8, the amount of operation time in which the breaker 7 is in the operation state is measured and the accumulated amount of the operation time is stored. The accumulated amount of the operation time is indicated on the display portion 54*a* of the monitor panel 54. Note that the accumulated amount of the operation time may be confirmed through a remote terminal device via radiotelegraphy.

According to this embodiment, since, if determining that the breaker 7 is in the operation state, the controller 45 measures the amount of operation time in which the working equipment is in the operation state and stores the accumulated amount of the operation time, it is possible to determine the damaged degree of a machine body or the like based on the accumulated amount of the operation time. Therefore, it is possible to optimize the timing of maintenance, rental fee, the estimate of a pre-owned machine, and the like.

Note that, although, in the foregoing embodiments, the hydraulic breaker 7 is mounted as an example of working equipment (attachment for work) of the hydraulic shovel 1, the present invention can be applied to the hydraulic shovel with a hydraulic compactor as working equipment mounted thereto. In this case, though not illustrated, this hydraulic compactor includes a vibration generating device that has a cylinder and a piston that is supplied with the pressure oil from the hydraulic pump and vibrates within the aforementioned cylinder. The hydraulic compactor is configured to suitably perform compaction by means of a compaction plate that receives vibration of the piston that vibrates in the vibration generating device.

Fifth Embodiment

Although, in the foregoing embodiments, it is determined whether the breaker 7 is in the operation state or not based on the frequency characteristic, and the amplitude center value and the amplitude value of the pump pressure waveform, the type of working equipment can be determined instead of or in addition to the operation state of working equipment.

In this embodiment, the controller 45 stores in advance the model data of the amplitude center value, the amplitude value and the frequency characteristic of the pump pressure waveform for each type of working equipment. The controller 45 compares the model data with the amplitude center value, the amplitude value and the frequency characteristic of the pump pressure waveform that are calculated based on pump pressure values that are detected by the pressure sensor 48 (hereinafter, referred to as "detection data"), and determines a currently-mounted working equipment.

For example, the controller 45 stores in advance the model data of a breaker (hereinafter, referred to as a "breaker model") similar to the data shown in the diagram (a) of FIG. 4 and the diagram (a) of FIG. 5, the model data of a bucket for skeleton work (hereinafter, referred to as a "skeleton model") similar to the data shown in the diagram (b) of FIG. 4 and the diagram (b) of FIG. 5, and the model data of a bucket for dump truck loading work (hereinafter, referred to as a "loading-of-dump-truck model") similar to the data shown in the diagram (c) of FIG. 4 and the diagram (c) of FIG. 5. The controller 45 compares detection data with the breaker model, the skeleton model and the loading-of-dump-truck model, and searches for model data that matches the detection data. For example, in the case where the detection data matches the breaker model, the controller 45 determines that the breaker is mounted.

Note that, as for the "type" used herein, devices of the same working equipment with different specifications are distinguished from each other as different types. For example, the controller 45 can store in advance the model data related to a plurality of breakers with different specifications to compare detection data with the model data related to a plurality of breakers with different specifications, and can determine the type of the breaker.

According to this embodiment, the type of working equipment can be determined based on the amplitude center value, the amplitude value and the frequency characteristic of the pump pressure waveform. Therefore, it is possible to surely determine the type of the currently-mounted working equipment. The controller 45 can thus automatically recognize the type of working equipment, and can execute suitable control in accordance with the type of working equipment.

Note that comparison between the detection data and the model data is not limited to complete matching, but the determination whether the detection data matches the model data may be made inconsideration of some extent of expected error.

Other Embodiments

In the foregoing embodiments, although the frequency analysis of the pump pressure waveform has been conducted using fast Fourier transform, the frequency analysis method in the present invention is not limited to this.

Also, in the case where the present invention is applied to a known attachment-type hydraulic shovel, there is an advantage that can provide the aforementioned effect by changing the software logic of the controller 45 without mounting any additional component to the hydraulic shovel.

The present invention provides an effect that can surely determine whether working equipment such as a hydraulic breaker is in an operation state. Therefore, the present invention is useful for working machines.

The invention claimed is:

1. A working machine control device adapted to control a working machine to which one of a plurality of types of equipment is mounted with at least one of the plurality of types of equipment being working equipment that is operated by a vibration generating device that is supplied with pressure oil from a hydraulic pump to generate vibration, the working machine control device comprising:

a pressure sensing section configured and arranged to detect a pump pressure of said hydraulic pump; and a controller configured to obtain frequency characteristic of the pump pressure based on a pump pressure value that is detected by said pressure sensing section, to determine a type of equipment mounted to the working machine based on said frequency characteristic, and to determine whether said working equipment that is operated by the vibration generating device is mounted to the working machine and in an operation state or not based on said frequency characteristic.

2. The working machine control device according to claim 1, further comprising a flow rate adjustment section configured and arranged to adjust a flow rate of the pressure oil that is supplied from said hydraulic pump to said working equipment, wherein said controller is configured to selectively control the working machine in at least one of a prescribed control mode for working by using said working equipment, and a different control mode different from the prescribed control mode, and said controller is further configured to send a command signal to said flow rate adjustment section to limit the flow rate of the pressure oil that is supplied from said hydraulic pump to said working equipment when the controller determines that said working equipment is in the operation state while said different control mode is executed.

3. The working machine control device according to claim 1, wherein said controller is configured to selectively control the working machine in at least one of a prescribed control mode for working by using said working equipment and a different control mode different from the prescribed control mode, and said controller is further configured to switch from said different control mode to the prescribed control mode as a control mode to be executed when the controller determines that said working equipment is in the operation state while said different control mode is executed.

4. The working machine control device according to claim 1, wherein said controller is configured to measure an amount of operation time in which said working equipment is in the operation state and to store an accumulated amount of the operation time when the controller determines that said working equipment is in the operation state.

5. The working machine control device according to claim 1, wherein said controller is configured to determine the type of the equipment mounted to the working machine based on said frequency characteristic, and an amplitude center value and an amplitude value of a waveform of the pump pressure.

6. A working machine including the working machine control device according to claim 1.

7. A working machine control device adapted to control a working machine with working equipment that is operated by a vibration generating device that is supplied with pressure oil from a hydraulic pump to generate vibration, the working machine control device comprising:

a pressure sensing section configured and arranged to detect a pump pressure of said hydraulic pump;

a controller configured to obtain frequency characteristic of the pump pressure based on a pump pressure value that is detected by said pressure sensing section, and to determine whether said working equipment is in an operation state or not based on said frequency characteristic; and an alarm issuing section configured and arranged to issue an alarm, wherein said controller is configured to selectively control the working machine in at least one of a prescribed control mode for working by using said working equipment and a different control mode different from the prescribed control mode, and said controller is further configured to send a command signal to said alarm issuing section to issue the alarm when the controller determines that said working equipment is in the operation state while said different control mode is executed.

8. The working machine control device adapted to control a working machine with working equipment that is operated by a vibration generating device that is supplied with pressure oil from a hydraulic pump to generate vibration, the working machine control device comprising:

a pressure sensing section configured and arranged to detect a pump pressure of said hydraulic pump; and a controller configured to obtain frequency characteristic of the pump pressure based on a pump pressure value that is detected by said pressure sensing section, and to determine whether said working equipment is in an operation state or not based on said frequency characteristic, said controller being configured to determine whether said working equipment is in the operation state or not based on said frequency characteristic, and an amplitude center value and an amplitude value of a waveform of the pump pressure.

* * * * *